US005267680A

United States Patent [19]

Torok

[11] Patent Number: 5,267,680

[45] Date of Patent: Dec. 7, 1993

[54] CARRYING SLING FOR INFANT CARRIER OR CAR SEAT

[76] Inventor: Raymond C. Torok, 10720 Alderbrook La., Cupertino, Calif. 95014

[21] Appl. No.: 839,572

[22] Filed: Feb. 21, 1992

[51] Int. Cl.[5] ..... A47D 13/02

[52] U.S. Cl. ..... 224/158; 224/258; 224/264; 224/901; 297/183; 297/256.13

[58] Field of Search ..... 224/158, 159, 160, 161, 224/257, 258, 264, 901; 297/250, 183

[56] References Cited

U.S. PATENT DOCUMENTS

| | | | |
|---|---|---|---|
| 982,376 | 1/1911 | MacFarlane | 224/158 |
| 2,628,358 | 2/1953 | Neils | 224/158 |
| 2,689,672 | 9/1954 | Thompson . | |
| 2,804,249 | 8/1957 | Manalo . | |
| 2,846,699 | 8/1958 | Watson . | |
| 3,587,952 | 6/1971 | Higuchi | 224/160 |
| 4,487,346 | 12/1984 | Fischer | 224/160 |
| 4,510,634 | 4/1985 | Diedrich et al. . | |
| 4,516,806 | 5/1985 | McDonald et al. | 297/457 |
| 4,544,088 | 10/1985 | Reding | 224/159 |
| 4,634,175 | 1/1987 | Wise | 297/183 |
| 4,688,850 | 8/1987 | Brownlie et al. | 297/270 |
| 4,861,105 | 8/1989 | Merten et al. | 297/250 |

FOREIGN PATENT DOCUMENTS

| | | | |
|---|---|---|---|
| 144648 | 10/1980 | Fed. Rep. of Germany | 224/158 |
| 428 | of 1859 | United Kingdom | 224/158 |

*Primary Examiner*—Linda J. Sholl

[57] ABSTRACT

A carrying sling for an infant carrier or car seat is disclosed. The sling uses a strap held in the hand or across the shoulder from which the occupied carrier is suspended by means of multiple support straps. The support straps contain length adjustors and buckles which allow the sling to open for loading and unloading the carrier. The support straps are also provided with means of attachment to the carrier frame.

8 Claims, 2 Drawing Sheets

CARRYING SLING FOR INFANT CARRIER OR CAR SEAT

BACKGROUND—FIELD OF INVENTION

This invention relates to portable infant carrier devices, specifically to a carrying sling for infant carrier devices of molded plastic or similar construction.

BACKGROUND—DESCRIPTION OF PRIOR ART

The transporting of small children or infants when carrying them by hand presents many problems for the adult transporting the child, particularly when trying to accomplish other deeds or acts. Typical problems involve opening and closing doors, carrying the child over extended distances, and combining activities such as shopping with automobile transport that requires the use of a specialized infant car seat.

Heretofore, various types of infant carriers and dual-purpose carrier/car seat devices have been known. Some carriers use a frame of plastic or other semi-rigid materials to provide a support structure for a seat to hold the child for one or several of various activities such as feeding, sleeping, playing, or travelling in automobiles. An intended advantage of some of these carriers, particularly those fitted with handles, is that they can be used to transport a child, avoiding the inconvenience of disturbing the baby unnecessarily. A typical application would be a car seat. Some are designed so that the car seat with the child in it can easily be placed inside a car and secured with a seat belt or can just as easily be removed from the car. While adequate for their primary purpose as a specialized seat, such carriers are awkward when used to carry an infant by hand.

Car seat type carriers have been used with only a few basic means of transporting by hand. Some use a rigid handle by which the carrier can be transported in a pendulum-like manner. Others use hand grips molded into the edges of the plastic seat frame. Both methods have significant disadvantages.

Carriers with handholds only in the frame structure require the use of two hands to transport a child in the carrier. Examples of such handholds are shown in U.S. Pat. No. 4,861,105 to Merten, et al. entitled "Infant Car Seat Mountable on a Grocery Cart" (1988) and U.S. Pat. No. 4,510,634 to Diedrich, et al. entitled "Infant Carrier" (1985).

Requiring the use of two hands to transport the carrier results in extreme inconvenience in many common situations. For example, the carrier and infant must be set down to open and close doors, transport other articles, or to perform almost any action requiring use of the hands. With a car seat type carrier, the bearer of the carrier might have to balance the carrier on one knee to open a door, thereby placing the infant in a precarious position.

In addition to the obvious inconvenience for the user of the carrier, setting the carrier down can put the baby at risk. If the only surface available to support the baby and carrier is at ground level, this might allow other children or animals access to the baby. In a parking lot the baby might have to be set on the ground in an empty parking space or a roadside, where moving cars are an ever-present danger. In a crowd of people, having to set the baby down might result in the bearer of the carrier becoming separated from the baby.

Several infant carrier designs use a rigid handle which attaches to the sides of the carrier and forms an arch above the carrier with a handgrip centered above the infant. Examples of this type are described in U.S. Pat. No. 4,516,806 to McDonald entitled "Portable Infant Carrier" (1985), U.S. Pat. No. 4,688,850 to Graco entitled "Infant Seat" (1987), and U.S. Pat. No. 4,634,175 to Gerber entitled "Baby Carrier" (1983).

Carriers with rigid arch-type handles require the use of at least one hand for support. Additionally, they require substantial strength on the part of the bearer and are only practical for very short duration usage. Those with the handle oriented across the seat or perpendicular to the baby's body are awkward to carry at the user's side. Because of the handle orientation the user's arm must be twisted so the palm faces either forward or backward. This places undue strain on the elbow. When carrying an article at the side, it is far easier to grip a suitcase-type handle, oriented parallel to the direction of travel, with the palm facing the body. Additionally, when the carrier is held at the user's side, the width of the carrier forces the hand to be held away from the body. This increases the strain on the elbow, shoulder, and back. This effect is exacerbated by handle configurations and attachment mechanisms which increase the overall width of the carrier.

Some infant carrier designs use various combinations of straps to support the infant against the body of the bearer. Examples of these types are described in U.S. Pat. No. 2,804,249 to Manalo entitled "Infant Carrying Device—Infant Safety" (1957), U.S. Pat. No. 2,846,699 to Watson entitled "Infant Carrier Device" (1958), U.S. Pat. No. 4,544,088 to Reding entitled "Child Carrying Harness" (1985), and U.S. Pat. No. 2,689,672 to Thompson entitled "Infant Carrier" (1954). None of these are appropriate for use with a more modern rigid shell type carrier like those used as car seats.

U.S. Pat. No. 2,846,699 shows a carrier of tubular frame and cloth construction that uses a carrying strap. The strap assembly uses four attachment points to the tubing framework. This arrangement is incompatible with more modern molded plastic infant carriers for several reasons. It is intended for a flat carrier that holds an infant in a reclined position, rather than in an upright sitting position. The use of two attachment points near the feet would interfere with the restraint systems used in car seat type carriers. The use of a fixed attachment at the point where the harness splits near the head of the carrier causes the carrier to tip when slung against the side of the bearer. It also increases the horizontal force between the bearer and the carrier, increasing the tendency for the strap to slide off the shoulder of the bearer. The strap could be supported on the shoulder opposite the carrier to counteract this effect (as shown in U.S. Pat. No. 2,846,699), with the additional inconvenience of having to lift the strap over the head every time the carrier is picked up or set down.

OBJECTS AND ADVANTAGES

Accordingly, the primary object of the present invention is to enhance the usefulness of infant carriers and car seats having rigid or semi-rigid structure. This invention seeks to make it easier for a person to transport such a carrier when it is occupied by a child. Several other objects and advantages of the invention are:

(a) to provide a way in which an occupied infant carrier or car seat may be borne by a person leaving at least one arm and hand free for other activities.

(b) to provide a way in which an occupied infant carrier or car seat may be borne by the person supporting the load either in the hand or on the shoulder.

(c) to be installable on existing infant carriers and car seats as an accessory item.

(d) to perform its function without impairing any existing capabilities of a carrier or car seat on which it is installed.

DRAWING FIGURES

FIG. 4A shows a cutaway view of a support strap attachment point to the infant carrier.

FIG. 4B shows an alternative support strap attachment method using slots in the carrier frame.

FIG. 4C shows an alternative support strap attachment method using a clip which attaches to the edge of the carrier frame.

Figure 1:
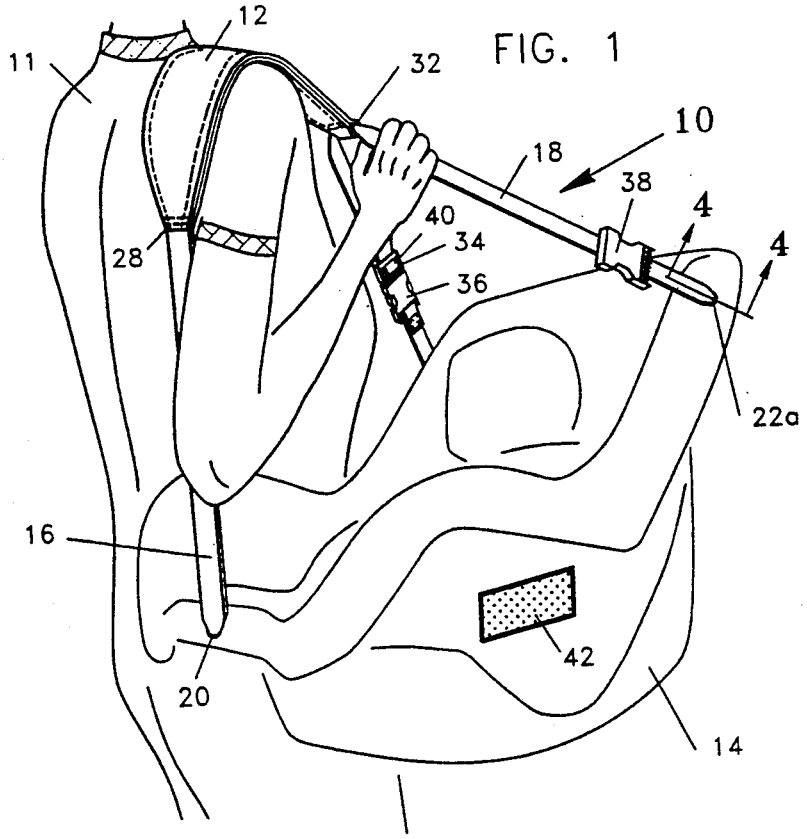
FIG. 1 shows a perspective view of the sling being used to support the infant and carrier on the bearer's shoulder.

| Reference Numerals in Drawings | |
|---|---|
| 10 | sling |
| 12 | handle/shoulder strap |
| 14 | infant carrier |
| 16 | lengthwise support strap |
| 18 | transverse support strap |
| 20 | lengthwise strap attachment point |
| 22a, 22b | transverse strap attachment points |
| 24 | padding |
| 26 | anti-slip strip |
| 28 | lengthwise strap to handle attachment |
| 30 | strap lock |
| 32 | loop for transverse strap sliding attachment |
| 34 | buckle connector, male |
| 36 | buckle connector, female |
| 38 | retainer |
| 40 | length adjustment |
| 42 | hooked fastener pad |
| 44 | attachment holes |
| 46 | carrier frame |
| 47 | carrier interior padding |
| 48 | strap locking slots |
| 50 | attachment hook |
| 52 | locking tabs |

DESCRIPTION—FIGS. 1 TO 4

Figure 2:
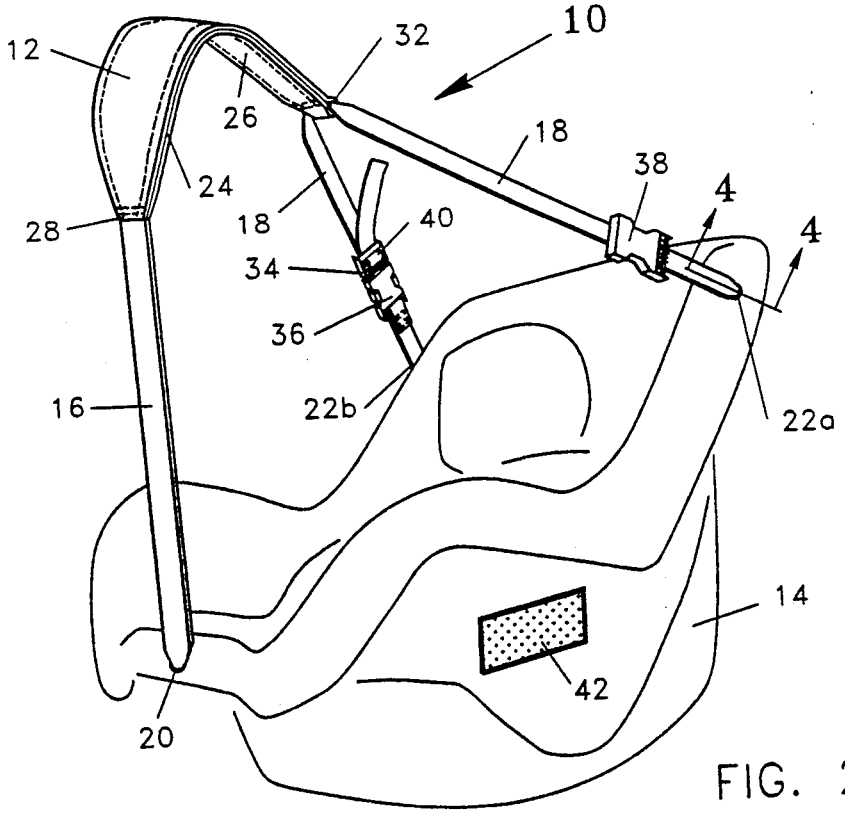
FIG. 2 shows a perspective view of the sling in use.
Figure 3:
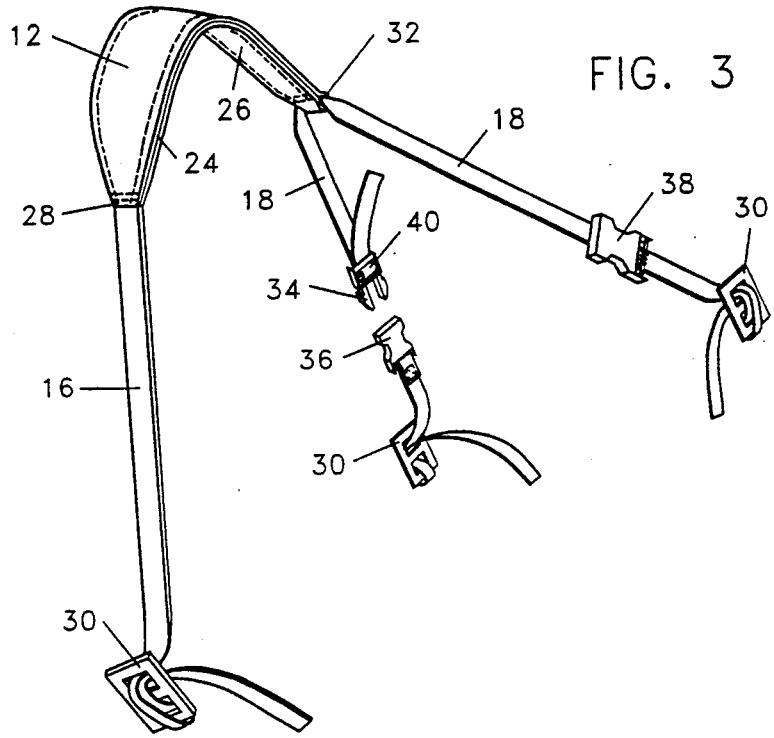
FIG. 3 is a perspective view of the sling detached from the carrier, showing attachment and adjustment mechanisms.

A typical embodiment of the present invention is shown in FIGS. 1, 2 and 3. Reference character 10 indicates a carrying sling for an infant carrier or car seat 14. The sling comprises a handle/shoulder strap 12 connected to the infant carrier 14 through lengthwise and transverse support straps 16 and 18, that are attached to the carrier at three locations, 20, 22*a* and 22*b*.

The handle/shoulder strap 12 is sufficiently long and wide so as to offer adequate load distribution capability when used as a shoulder strap. It is padded 24, and an anti-slip strip 26 protects against the strap slipping off the shoulder.

At one end 28 the handle/shoulder strap 12 is attached to the upper end of the lengthwise support strap 16 using a sewn or adhesively bonded connection or equivalent means. The lengthwise support strap 16 passes through a hole in the carrier frame at the attachment point 20 on the carrier centerline near the foot end of the carrier and then engages a moveable locking device 30. The strap lock 30 provides both a means of attachment to the infant carrier frame and a strap length adjustment.

At its upper end the handle/shoulder strap 12 contains a loop 32, either sewn or adhesively bonded or fashioned using equivalent means, through which passes the transverse support strap 18. The two ends of the transverse support strap 18 pass through holes in either side of the carrier frame at their attachment points 22*a* and 22*b* in the vicinity of the infant's head. The strap ends then engage movable locking devices 30, that provide a method of attachment and strap length adjustment.

The transverse support strap 18 incorporates buckle parts 34 and 36, which allow the sling to be opened to admit the infant to the carrier. In the open position both ends of the transverse support strap 18 are held to one side of the carrier by engaging the male buckle connector 34 in a retainer 38, which is attached to the transverse support strap 18 near the end opposite the female buckle connector 36. Additional length adjustment is provided at one of the buckle-to-strap connection points 40.

The transverse support strap 18 must be long enough in the installed configuration so that the shell is inherently stable relative to tipping sideways when suspended from the sling. With the carrier suspended, the sliding joint between the transverse and lengthwise straps formed by the loop 32 is free to move in response to shifts in the infant's position and center of gravity. If the carrier shell starts to tip sideways and the transverse strap is too short, the carrier will continue to tip more until the sliding joint loop 32 is next to one of the shell attachment points of the transverse strap 22*a* and 22*b*, and the carrier is oriented nearly sideways. Thus, if the transverse support strap 18 is too short, the sling/carrier combination will be inherently unstable. The preferred length of the transverse support strap 18 to ensure stability of the child carrier is greater than approximately 140 percent of the distance between the attachment points 22*a* and 22*b*, preferably between 140 and 250 percent of the distance between the attachment points 22*a* and 22*b*.

OPERATION—FIGS. 1, 2, 3 and 4

When mounted on the infant carrier 14, the sling 10 can be used to support the carrier either by the hand or shoulder of the bearer. Support strap length adjustments 30, 40 are used to adjust the attitude of the carrier for the infant's comfort. The handle/shoulder strap 12 may be held or slung across the shoulder in either direction, allowing the infant to be carried facing forward or backward with equal comfort. The sliding attachment 32 of the transverse support strap 18 to the handle/shoulder strap 12 allows the carrier to remain approximately horizontal when supported at the shoulder with the carrier leaning against the bearer's hip. The sliding attachment method also reduces the horizontal force between the infant carrier 14 and the bearer, reducing the tendency for the shoulder strap 12 to slide off the shoulder. The arm and hand of the support shoulder can be used to steady the carrier, locking it against the side of the bearer for additional safety.

When not in use supporting the infant and carrier, the sling is opened by means of the buckle 34 and 36 in the transverse support strap 18, and the movable buckle part 34 is engaged in the retainer 38, holding the entire sling on one side of the carrier. The sling is then held outside the carrier, away from the infant, by engaging the handle/shoulder strap 12 with a hooked fastener pad 42 on the side of the carrier. In the preferred embodiment of the sling, VELCRO hook and loop fasteners hold the sling in the stowed position. VELCRO is a trademark of Velcro USA INC., Manchester, N.H.

Many alternative materials and attachment methods are suitable for use in the present invention. The support straps 16 and 18 and the handle/shoulder strap 12 are formed of any suitable flexible material, such as woven nylon or polypropylene. The support straps need not be of any particular cross-section; they could be generally circular, like rope, or rectangular, like webbing, or of any number of other forms. Many forms of buckles, strap clamps, and strap length adjusters are well known and could be substituted for the types shown in FIGS. 1,2,3,4. Strap-to-handle attachments could be sewn or glued or use hardware connectors, such as DEE rings, grommets or rivets. The handle/shoulder strap 12 could be an integral part of the lengthwise support strap 16 if the material used for the lengthwise support strap 16 is sufficiently wide to also act as a shoulder strap.

In light of the intended use, safety and reliability are of paramount importance, so the selected components and materials should be simple and strong. The preferred embodiment reflects these sentiments.

In the preferred embodiment the sling 10 is attached to the infant carrier 14 at three locations 20, **22*a*, and 22*b*. All attachment points are near the outer edges of the carrier 14 to spread the attachment points as far as possible for maximum stability. To further improve stability, the attachment points 20, 22*a*, and 22*b* are high on the carrier frame, keeping the center of gravity of the infant and carrier as low as possible relative to the attachment points. Additionally, the transverse support strap 18 should engage the handle/shoulder strap 12 as high as possible above the attachment points 22*a*, 22*b*, also for maximum stability. Keeping the attachment loop 32 high allows the sling to accommodate greater lateral shifts in the center of gravity of the infant/seat combination (due to movement of the infant) with less tilting, thereby increasing both comfort and safety. Additionally, a high attachment point provides greater clearance for the infant's head and decreases stresses in the transverse support strap 18, the carrier frame at the attachment points 22*a*, 22*b*, and the strap locks 30**. The arrangement of sling attachment points, with one centered near the feet and two spread apart near the head, minimizes interference with the infant carrier restraint system, which typically uses two shoulder straps and a central lower attachment point between the infant's legs.

Other configurations could be used, including ones with two or four support strap attachment points. However, the preferred embodiment described above offers advantages in both functionality and safety. Two attachment points, both on the longitudinal centerline of the infant carrier 14, could be used, but the infant/carrier combination would have limited stability against rotation about the longitudinal axis. It would require an exceptionally low center of gravity to maintain stability, possibly needing ballast to prevent accidental overturning. A four-point attachment scheme would require extra hardware and would have stability problems if sliding attachments were used as in the present invention. Without sliding attachments, the infant carrier would be tilted farther when suspended against the side of the bearer and would cause greater sideways forces against the bearer, tending to make the shoulder strap slide off. Additionally, using two attachment points at the foot end of the infant carrier would result in more complicated procedures to prevent the infant's legs and the seat restraint system from becoming entangled in the sling.

Figure 4A:
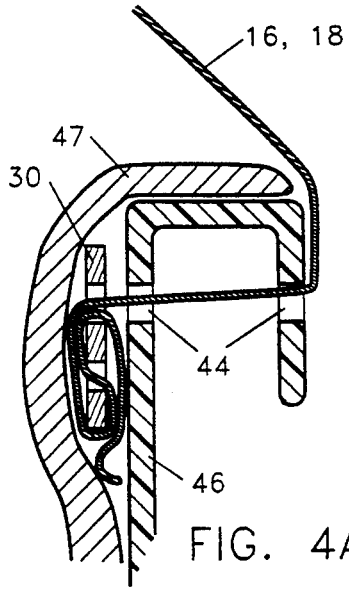
FIGS. 4A to 4C are views in detail of the portion indicated by the section lines 4—4 in FIG. 1 and FIG. 2.
Figure 4B:
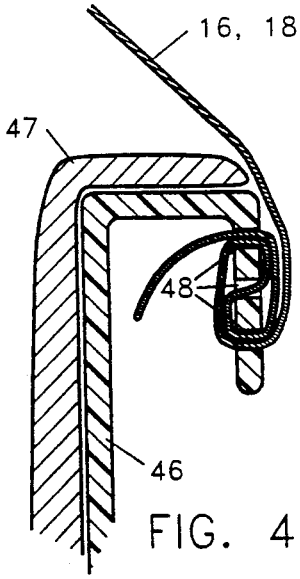
Figure 4C:
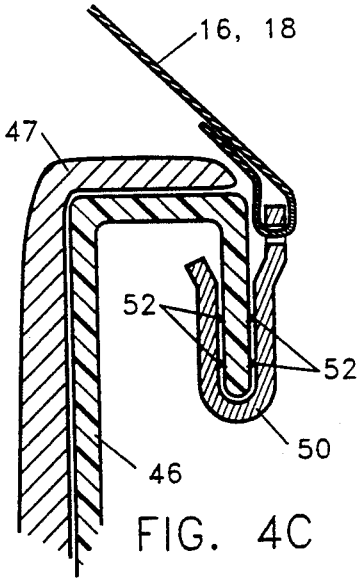

As also will be readily appreciated, alternative strap attachment methods could be used. FIGS. 4A, 4B, 4C show cross-section views of three possible attachment methods. The preferred embodiment shown in FIG. 4A has the support straps 16, 18 passing through holes 44 in the carrier frame 46 and engaging locks 30 which prevent their withdrawal. The circuitous path of the strap 16, 18 through the lock 30 provides sufficient friction to prevent slippage, without using moving parts. The installed strap lock 30 and excess strap lie out of sight under the carrier padding 47. Many well known variations on this simple friction lock could be substituted for the one shown. This method is preferred because of its strength, simplicity, and light weight. In the mounting configuration of FIG. 4A the lock 30 would have to break or tear through two parts of the carrier frame for the attachment to fail.

FIG. 4B shows an attachment method that provides the same friction locking function using slots 48 in the carrier frame 46 instead of the strap lock 30. FIG. 4C shows an attachment method which uses a hooked end fitting 50 on the strap to clamp under the edge of the carrier frame 46. Locking tabs 52 hold the hook 50 in place. This method accomplishes attachment without adding holes to the carrier frame, but at the expense of extra hardware and weight.

SUMMARY, RAMIFICATIONS, AND SCOPE OF INVENTION

Thus the reader will see that the carrying sling of this invention provides an economical, easy to use device which can enhance the usefulness of a variety of infant carriers and car seats. Furthermore, the carrying sling has the additional advantages in that:

- it provides a way in which an occupied infant carrier or car seat may be borne by a person leaving at least one arm and hand free for other activities.
- it provides a way in which an occupied infant carrier or car seat may be borne by the person supporting the load either in the hand or on the shoulder.
- it is installable on existing infant carriers and car seats as an accessory item.
- it performs its function without impairing any existing capabilities of a carrier or car seat on which it is installed.

While my above description contains many specificities, these should not be construed as limitations on the scope of the invention, but rather as an exemplification of one preferred embodiment thereof. Many other variations are possible. For example, the sling could use four attachment points, one at each corner of the infant carrier. Two of the support straps might then have buckles to open the sling, or the sling might open using a single buckle at the handle. Retainers and restraints for when the sling is open could be rearranged correspondingly. Possibly variations on the materials and methods of construction, attachment and adjustment are endless.

Accordingly, the scope of the invention should be determined not by the embodiment illustrated, but by the appended claims and their legal equivalents.

I claim:

1. In combination:

a child carrier of the type having a rigid outer shell, said rigid outer shell having a head end and a foot end, a left side and a right side, and a carrying sling comprising:

a lengthwise strap having an upper end and a lower end, said lower end being attached to said rigid outer shell proximate the center of said foot end, said upper end extending toward said head end of said rigid outer shell, a loop formed on said upper end of said lengthwise strap, a slip resistant shoulder pad attached to said lengthwise strap intermediate said upper end and said lower end, and a transverse strap having a first end and a second end, said transverse strap passing through said loop in said lengthwise strap, said loop being freely slidable along the length of said transverse strap, said first end of said transverse strap being attached to one side of said rigid outer shell proximate said head end, said second end of said transverse strap being attached to the opposite side of said rigid outer shell proximate said head end.

2. The combination of claim 1, wherein said first end of said transverse strap is attached to said rigid outer shell with a detachable buckle, and said second end of said transverse strap has a retainer attached thereto, said retainer having means for attaching said first end of said transverse strap thereto when said first end is detached from said rigid outer shell.

3. The combination of claim 2, further comprising an attachment means for attaching said lengthwise strap to the exterior of said rigid outer shell when said sling is not in use, said attachment means being located on the same side of said rigid outer shell as said retainer means intermediate said head end and said foot end.

4. The combination of claim 1, wherein said transverse strap has a length which is between 140% to 250% of the distance between the attachment points of said two ends of said transverse strap on said rigid outer shell.

5. The combination of claim 2, wherein said lower end of said lengthwise strap and said second end of said transverse strap are attached to said rigid outer shell with detachable buckles.

6. The combination of claim 5, further comprising a means for adjusting the length of said lengthwise strap and a means for adjusting the length of said transverse strap.

7. The combination of claim 1, wherein said lengthwise strap passes through a slot in said foot end of said rigid outer shell and said lower end of said lengthwise strap is secured to said rigid outer shell by a friction lock, said friction lock being attachable to said lengthwise strap at different points along the length of said lengthwise strap, said friction lock being larger than said slot so as to secure said lower end of said lengthwise strap to said rigid outer shell, and wherein at least one end of said transverse strap passes through a second slot in the side of said rigid outer shell proximate said head end and said at least one end of said transverse strap is secured to said rigid outer shell by a second friction lock, said second friction lock being attachable to said transverse strap at different points along the length of said transverse strap, said second friction lock being larger than said second slot so as to secure said at least one end of said transverse strap to said rigid outer shell.

8. In combination:

a child carrier of the type having a rigid outer shell, said rigid outer shell having a head end and a foot end, a left side and a right side, and a carrying sling comprising:

a lengthwise strap having an upper end and a lower end, said lower end being attached to said rigid outer shell proximate the center of said foot end, said upper end extending toward said head end of said rigid outer shell, a loop formed on said upper end of said lengthwise strap, a slip resistant shoulder pad attached to said lengthwise strap intermediate said upper end and said lower end, a transverse strap having a first end and a second end, said transverse strap passing through said loop in said lengthwise strap, said loop being freely slidable along the length of said transverse strap, said first end of said transverse strap being detachably attached to one side of said rigid outer shell proximate said head end by means of a detachable buckle, said second end of said transverse strap being attached to the opposite side of said rigid outer shell proximate said head end, said second end of said transverse strap having a retainer attached thereto, said retainer having means for attaching said first end of said transverse strap thereto when said first end is detached from said rigid outer shell, and an attachment means for attaching said lengthwise strap to the exterior of said rigid outer shell when said sling is not in use, said attachment means being located on the same side of said rigid outer shell as said retainer means intermediate said head end and said foot end.

* * * * *